US008913907B2

(12) United States Patent
Akita

(10) Patent No.: US 8,913,907 B2
(45) Date of Patent: Dec. 16, 2014

(54) IMAGE FORMING BY USING A DISTRIBUTION OF HEIGHTS

(75) Inventor: Masanori Akita, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 666 days.

(21) Appl. No.: 12/748,893

(22) Filed: Mar. 29, 2010

(65) Prior Publication Data

US 2010/0247125 A1 Sep. 30, 2010

(30) Foreign Application Priority Data

Mar. 31, 2009 (JP) ..... 2009-086514

(51) Int. Cl.
*G03G 15/00* (2006.01)
*G03G 15/01* (2006.01)

(52) U.S. Cl.
CPC .... *G03G 15/0131* (2013.01); *G03G 2215/0129* (2013.01); *G03G 15/50* (2013.01); *G03G 2215/0164* (2013.01)
USPC ..... 399/49; 399/72

(58) Field of Classification Search
USPC ..... 399/49, 72
See application file for complete search history.

(56) References Cited

U.S. PATENT DOCUMENTS

| | | | | |
|---|---|---|---|---|
| 5,909,235 | A * | 6/1999 | Folkins | 347/240 |
| 6,198,549 | B1 * | 3/2001 | Decker et al. | 358/504 |
| 6,198,896 | B1 * | 3/2001 | Nakayasu et al. | 399/301 |
| 6,714,748 | B1 * | 3/2004 | Nakayasu et al. | 399/72 |
| 7,102,661 | B2 * | 9/2006 | Satoh | 347/234 |
| 7,213,900 | B2 * | 5/2007 | Ebihara | 347/19 |
| 7,239,833 | B2 * | 7/2007 | Tomita et al. | 399/299 |
| 7,266,317 | B2 * | 9/2007 | Okano | 399/49 |
| 7,413,280 | B2 * | 8/2008 | Yasuda | 347/19 |
| 7,787,785 | B2 * | 8/2010 | Kidaka | 399/38 |
| 8,036,552 | B2 * | 10/2011 | Hashimoto | 399/49 |
| 2005/0047834 | A1 * | 3/2005 | Tomita et al. | 399/301 |
| 2006/0045577 | A1 * | 3/2006 | Maeda | 399/301 |
| 2006/0056882 | A1 * | 3/2006 | Kwon et al. | 399/301 |
| 2006/0170754 | A1 * | 8/2006 | Kitao | 347/116 |
| 2006/0222419 | A1 * | 10/2006 | Ishibashi et al. | 399/301 |
| 2007/0134014 | A1 * | 6/2007 | Kato et al. | 399/49 |
| 2007/0280746 | A1 * | 12/2007 | Watanabe et al. | 399/299 |

(Continued)

FOREIGN PATENT DOCUMENTS

| | | |
|---|---|---|
| JP | 8-327331 | 12/1996 |
| JP | 2005-14344 | 1/2005 |
| JP | 2007-65641 | 3/2007 |

OTHER PUBLICATIONS

Machine translation of JP 08-327331 published Dec. 13, 1996.*

*Primary Examiner* — David Bolduc
(74) *Attorney, Agent, or Firm* — Fitzpatrick, Cella, Harper & Scinto

(57) ABSTRACT

An image forming apparatus includes a toner image forming device for forming a color image. The toner image forming device forms a first color test image and a second color test image superposedly on an image conveying member so that at least one of a screen angle and a screen ruling with respect to the first color test image is different from that with respect to the second color test image. The image forming apparatus further includes a detecting device for detecting a distribution of heights of the first and second color test images formed superposedly on the image conveying member by the toner image forming device, and a control device for controlling a toner image forming condition of the toner image forming device on the basis of the distribution detected by the detecting device.

6 Claims, 12 Drawing Sheets

(56) References Cited

U.S. PATENT DOCUMENTS

2008/0170280 A1* 7/2008 Wang et al. ..... 358/534
2009/0034990 A1* 2/2009 Nakazato et al. ..... 399/9
2009/0067858 A1* 3/2009 Ishibashi ..... 399/39
2009/0162112 A1* 6/2009 Murayama ..... 399/301
2010/0027035 A1* 2/2010 Stelter et al. ..... 358/1.9

* cited by examiner (a) YELLOW (b) MAGENTA

IMAGE FORMING BY USING A DISTRIBUTION OF HEIGHTS

FIELD OF THE INVENTION AND RELATED ART

The present invention relates to an image forming apparatus such as a copying machine, a printer, a facsimile machine, or a multi-function machine having functions of these machines.

The image forming apparatus for forming a full-color image by transferring and superposing a plurality of colors of toner images from an image bearing member onto an image conveying member (an intermediary transfer member or a recording material conveying member) has been widely used. This full-color image forming apparatus includes those of a type in which a single (one) image bearing member for effecting development for the plurality of colors and of a type in which toner images of the plurality of colors are transferred superposedly from a plurality of image bearing members, respectively.

In the full-color image forming apparatus, when a ratio of toner amount per unit area among the plurality of colors of toner images is changed, a color tone of an intermediate color (secondary color) is changed, thus lowering an image quality. For that reason, a test image measuring mode in which a test image (patch toner image) for each of the plurality of colors is formed and is subjected to measurement of image density or color tone is executed with predetermined timing. In the test image measuring mode, the respective color test images (toner images) are formed under a predetermined condition and density measurement results of the test images are fed back to respective color toner image forming conditions to optimize a color balance of an output image.

In the test image measuring mode described in Japanese Laid-Open Patent Application (JP-A) 2005-14344, the respective color test images are superposed on the intermediary transfer member and then are transferred and fixed on a recording material, and thereafter the test images fixed on the recording material are subjected to measurement with a color sensor. For this reason, every execution of the test image measuring mode, the recording material is consumed and an unnecessary image is output.

In view of this problem, it has been proposed that a toner amount per unit are (hereinafter referred also to as a toner amount) of the test image of each of the plurality of colors is measured on the intermediary transfer member to execute the test image measuring mode without consuming the recording material.

In the test image measuring mode described in JP-A 2007-65641, the respective color test images (patch toner images) are transferred onto the intermediary transfer member at different positions and are individually subjected to measurement of the toner amount on the intermediary transfer member. The respective color test images transferred on the intermediary transfer member are successively irradiated with infrared rays issued from an optical sensor, so that the amount of regularly (specularly) reflected light is individually measured.

JP-A 8-327331 discloses the image forming apparatus in which a toner height is measured by using a laser displacement sensor for subjecting a surface irradiated with laser light to triangular distance measurement. Also, in this case, the respective color test images are separately subjected to measurement of height and then the measured height is converted into the toner amount.

However, in the control described in JP-A 2007-65641, test images of yellow, magenta, cyan and black are formed in a line, so that these test images are not accommodated within an interval between adjacent images (so-called sheet interval). In this case, when the interval between adjacent images is increased, the four color test images can be formed in the line but productivity of the image forming apparatus is lowered.

Further, in the case where the four color test images are formed at a plurality of intervals, an execution frequency of the test image measuring mode is lowered.

Further, in the case where a plurality of optical sensors is disposed and detects a plurality of colors of test image in parallel, a disposition cost of the optical sensors is increased and a variation in characteristic of the optical sensors results in an error of color adjustment.

SUMMARY OF THE INVENTION

A principal object of the present invention is to provide an image forming apparatus capable of executing a test image measuring mode without lowering image productivity and increasing costs.

According to an aspect of the present invention, there is provided an image forming apparatus comprising:

- a toner image forming device for forming a color image, wherein the toner image forming device forms a first color test image and a second color test image superposedly on an image conveying member so that at least one of a screen angle and a screen ruling with respect to the first color test image is different from that with respect to the second color test image;
- a detecting device for detecting a distribution of heights of the first and second color test images formed superposedly on the image conveying member by the toner image forming device; and
- a control device for controlling a toner image forming condition of the toner image forming device on the basis of the distribution detected by the detecting device.

These and other objects, features and advantages of the present invention will become more apparent upon a consideration of the following description of the preferred embodiments of the present invention taken in conjunction with the accompanying drawings.

DETAILED DESCRIPTION OF THE PREFERRED EMBODIMENTS

Hereinbelow, embodiments of the present invention will be described with reference to the drawings. The present invention can also be carried out in other embodiments in which a part or all of constitutions in the following embodiments are replaced with alternative constitutions so long as a distribution of heights of superposed test images (patch toner images) with respect to a movement direction can be measured.

Therefore, the present invention is applicable to not only an image forming apparatus using an intermediary transfer member as an image conveying member but also an image forming apparatus using a recording material conveying member as the image conveying member. The present invention is also applicable to not only a tandem type in which a plurality of photosensitive drums is disposed along the image conveying member but also a one-drum type in which a single photosensitive drum is disposed in contact with the image conveying member. In the following embodiment, only a principal portion relating to formation and transfer of a test image will be described but the present invention can be carried out in various fields of uses such as printers, various printing machines, copying machines, facsimile machines, and multi-function machines by adding necessary device, equipment, and casing structure.

(Image Forming Apparatus)

Figure 1:
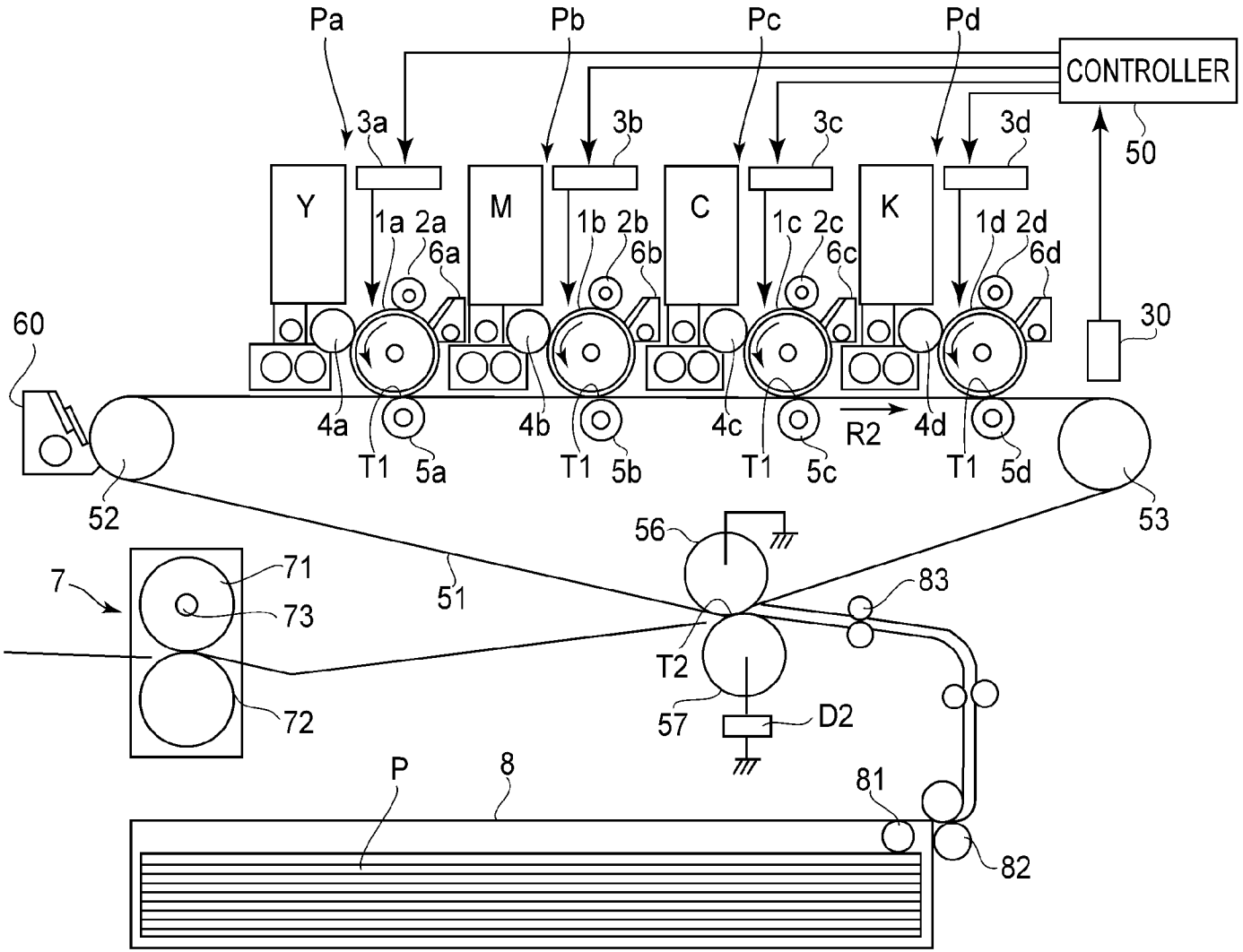
FIG. 1 is an explanatory view of a structure of an image forming apparatus.
Figure 2:
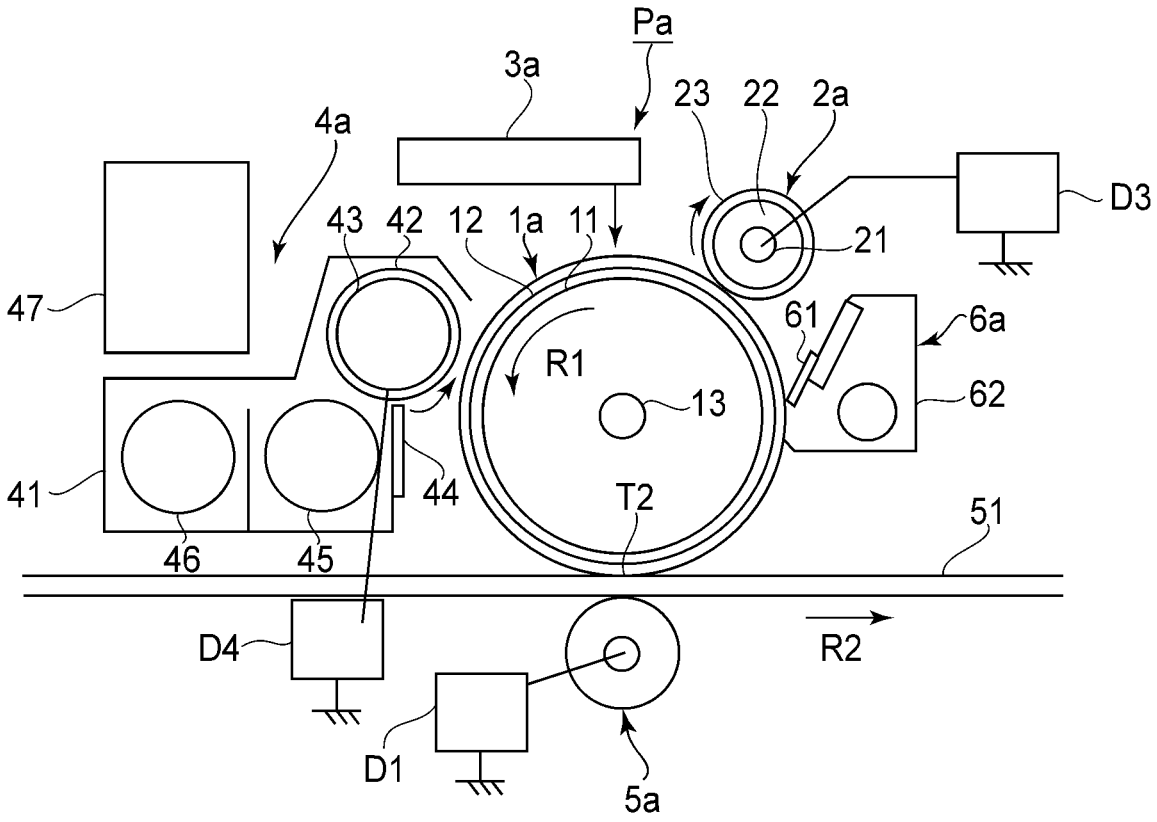
FIG. 2 is an explanatory view of a structure of an image forming portion.
Figure 3:
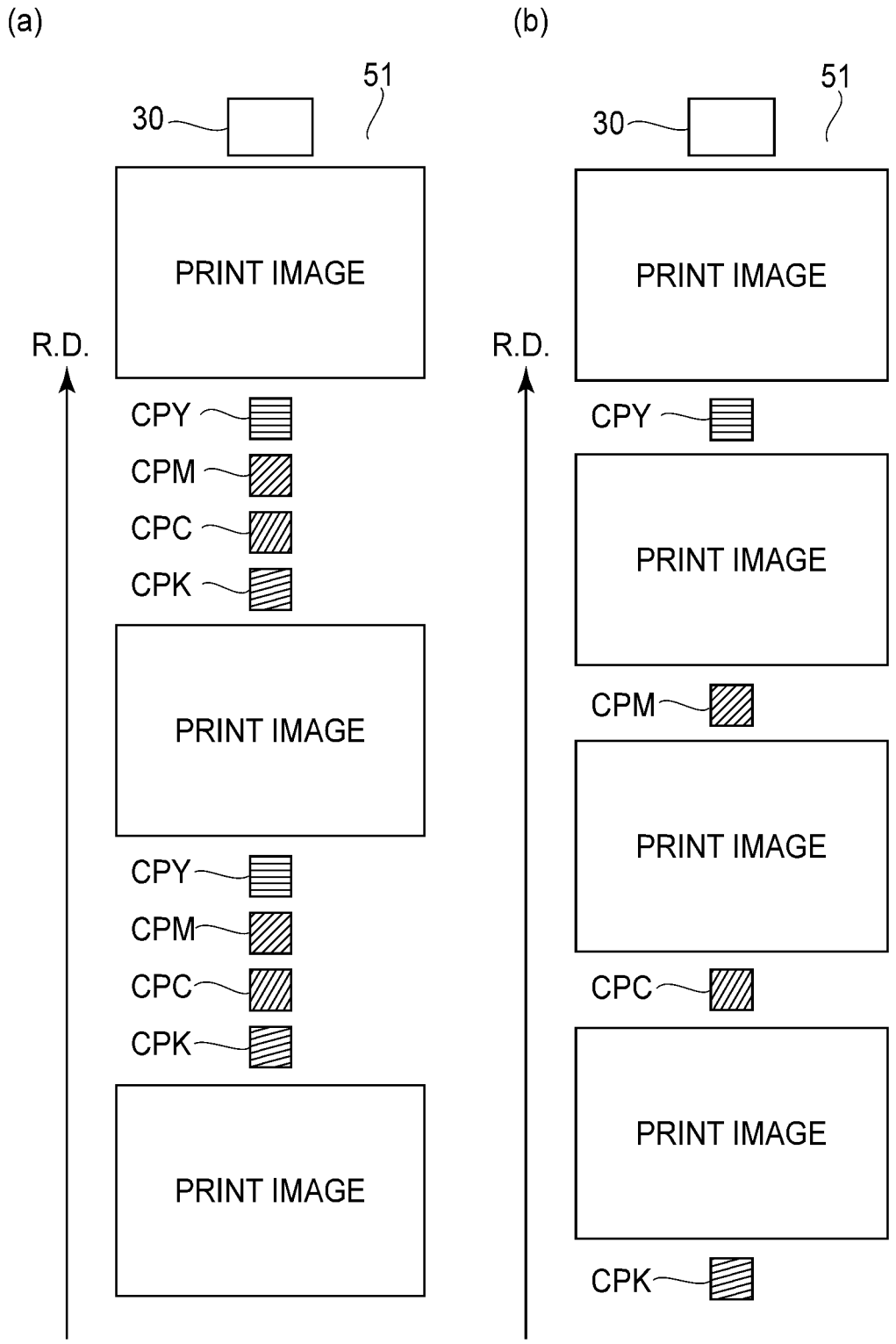
FIGS. 3(*a*) and 3(*b*) are explanatory views each showing an arrangement of patch toner images.

FIG. 1 is an explanatory view of a structure of the image forming apparatus and FIG. 2 is an explanatory view of a structure of an image forming portion. FIGS. 3(*a*) and 3(*b*) are explanatory views each showing an arrangement of patch toner images.

As shown in FIG. 1, an image forming apparatus 100 is a full-color printer of a tandem and intermediary transfer type in which image forming portions Pa, Pb, Pc and Pd as an example of a toner image forming device are arranged along an intermediary transfer belt 51 as an example of the intermediary transfer member. At each of the image forming portions, Pa, Pb, Pc and Pd, when an toner amount per unit area on a recording material P is 0.5 mg/cm$^2$, a reflection (image) density after fixation is set at about 1.6.

At the image forming portion Pa, a yellow toner image is formed on a photosensitive drum 1*a* and then is primary-transferred onto the intermediary transfer belt 51. At the image forming portion Pb, a magenta toner image is formed on a photosensitive drum 1*b* and then is primary-transferred superposedly onto the yellow toner image on the intermediary transfer belt 51. At the image forming portions, Pc, and Pc, a cyan toner image and a black toner image are formed on photosensitive drums 1*c* and 1*d*, respectively, and then are similarly primary-transferred successively and superposedly onto the intermediary transfer belt 51.

The four color toner images primary-transferred onto the intermediary transfer belt 51 are conveyed to a secondary transfer portion T2, at which the toner images are collectively secondary-transferred onto the recording material P. The recording material P on which the four color toner images are secondary-transferred are subjected to heat pressing by a fixing device 7, so that the toner images are fixed on the surface of the recording material P. Thereafter, the recording material P is discharged to the outside of the image forming apparatus 100.

The intermediary transfer belt 51 is stretched around and supported by a tension roller 52, a driving roller 53 and an opposite roller 56 and is driven by the driving roller 53 to be rotated in an arrow R2 direction at a process speed of 300 mm/sec. The intermediary transfer belt 51 is formed of a material adjusted in volume resistivity of 108.5 Ωcm by incorporating carbon black particles into a polyimide (PI) resin material and has a thickness of 100 μm, a width of 400 mm, and a peripheral length of 800 mm. The volume resistivity was measured by using a probe in accordance with JIS-K6911 under a condition including an applied voltage of 100 V, an application time of 60 sec, and an environment of 23° C. and 50% RH. However, the intermediary transfer belt 51 may also be formed with different volume resistivities and thicknesses by using other materials including dielectric resin materials such as PC, PDT and PVDF.

The recording material P drawn from a recording material cassette 8 by a pick-up roller 81 is separated one by one by separation rollers 82 and then is sent to registration rollers 83.

The registration rollers 23 receives the recording material P in a rest state and places the recording material P in a stand-by state and feeds the recording material P toward the secondary transfer portion T2 while timing the recording material P to the toner image on the intermediary transfer belt 51.

The secondary transfer roller 57 sandwiches the intermediary transfer belt 51 between itself and the opposite roller 56 connected to the ground potential to form the secondary transfer portion T2 between itself and the intermediary transfer belt 51. From a power source D2, the DC voltage is applied to the secondary transfer roller 57, so that the four color toner images which have been negatively charged and carried on the intermediary transfer belt 51 are secondary-transferred onto the recording material P nipped at the secondary transfer portion T2 between the intermediary transfer belt 51 and the secondary transfer roller 57.

In the fixing device 7, a pressing roller 72 press-contacts a rotatable fixing roller 71 in which a halogen lamp heater 73 is provided, so that a surface temperature of the fixing roller 71 is adjusted by controlling the voltage applied to the halogen lamp heater.

The image forming portions Pa, Pb, Pc and Pd have the substantially same constitution except that the colors of toners of yellow for a developing device 4*a* provided in the image forming portion Pa, magenta for a developing device 4*b* provided in the image forming portion Pb, cyan for a developing device 4*c* provided in the image forming portion Pc, and black for a developing device 4*d* provided in the image forming portion Pd are different from each other. In the following description, the image forming portion Pa will be described and with respect to other image forming portions Pb, Pc and Pd, the suffix a of reference numerals (symbols) for representing constituent members (means) is to be read as b, c and d, respectively, for explanation of associated ones of the constituent members.

As shown in FIG. 2, the image forming station Pa includes the photosensitive drum 1*a*. Around the photosensitive drum 1*a*, a charging roller 2*a*, an exposure device 3*a*, the developing device 4*a*, a primary transfer roller 3*a*, and a cleaning device 6*a* are disposed in the image forming portion Pa.

The photosensitive drum 1*a* is a cylindrical OPC photosensitive member prepared by forming a photoconductive layer 12 having a negative charge polarity on an outer peripheral surface of an aluminum electroconductive support 11.

The photosensitive drum 1*a* is rotated about a supporting shaft 13 in a direction of an arrow R1 at a process speed of 300 mm/sec. The charging roller 2 is prepared by forming a low-resistance electroconductive layer 22 and a medium-resistance electroconductive layer 23 on an outer peripheral surface of an electroconductive core metal 21. The charging roller 2 is rotatably shaft-supported at both end portions of the core metal 21 and is disposed in parallel to a rotational axis of the photosensitive drum 1*a*. The charging roller 2*a* contacts the photosensitive drum 1*a* and is rotated by the rotation of the photosensitive drum 1*a*. From a power source D3 to the charging roller 2*a*, an oscillating voltage in the form of a DC voltage based with an AC voltage is applied, so that the surface of the photosensitive drum 1*a* is electrically charged uniformly to a negative-polarity potential.

The exposure device 3*a* writes (forms) an electrostatic image for an image on the charged surface of the photosensitive drum 1*d* by scanning of the charged surface through a rotating mirror with a laser beam obtained by ON/OFF modulation of scanning line image data expanded from a separated color image for yellow.

The developing device 4*a* stirs a two component filled in a developing container 41 by stirring screws 45 and 46 developer, so that a magnetic carrier in the two component developer is positively charged and a non-magnetic toner in the two component developer is negatively charged. A developing sleeve 42 rotates around a fixed magnetic pole 43 in a counter direction with respect to the photosensitive drum 1*a* and magnetically carries the two component developer regulated in layer thickness by a regulating blade to cause the two component developer to slide on the photosensitive drum 1*a*. A power source D4 applies to the developing sleeve 42 an oscillating voltage in the form of a negative DC voltage biased with the AC voltage. As a result, the negatively charged toner is transferred onto the electrostatic image on the photosensitive drum 1*a* which is positively charged relative to the developing sleeve 42, so that the electrostatic image is reversely developed. The primary transfer roller 5*a* is constituted by disposing a cylindrical electroconductive layer on an outer peripheral surface of a core metal and is urged toward the photosensitive drum 1*a* at its both end portions by springs (not shown). As a result, the primary transfer roller 5*a* urges the intermediary transfer belt 51 against the photosensitive drum 1*a* with a predetermined urging force, thus forming a primary transfer portion T1 between the photosensitive drum 1*a* and the intermediary transfer belt 51.

From a power source D1, a positive DC voltage is applied to the primary transfer roller 5*a*, so that the toner image negatively charged and carried on the photosensitive drum 1*a* is primary-transferred onto the intermediary transfer belt 51 passing through the primary transfer portion T1.

The drum cleaning device 6*a* causes a cleaning blade 61 to press-contact the photosensitive drum la by a pressing means (not shown) with a predetermined angle and a predetermined pressure. The cleaning blade 62 of the cleaning device 6*a* slides on the photosensitive drum 1*a* to remove transfer residual toner which passed through the primary transfer portion T1 and remains on the surface of the photosensitive drum 1*a*, thus collecting the transfer residual toner in a collecting container 62.

As shown in FIG. 1, the image forming apparatus 100 forms the test images (patch toner images) for experimentally detecting the respective color toner amounts (image densities) on the intermediary transfer belt 51 in the test image measuring mode. Then, so-called toner image density control in which patch densities of these patch toner images are detected and compared with target densities and results thereof are fed back to image forming conditions at the image forming portions Pa, Pb, Pc and Pd is effected. The image forming conditions to be adjusted are an exposure amount of the exposure device, the DC voltage to be applied to the developing sleeve, a gradation level correction curve, a density correction table, and the like. As a result, the toner (image) density of the full-color image to be formed on the recording material is properly controlled, so that it is possible to obtain a color image with stable color tone.

However, in the test image measuring mode, an operation different from image formation to be normally performed by the image forming apparatus 100 is required. For this reason, when the test image measuring mode is included in the normal image forming operation, the control therefor is included in an interval between images to be output, so that an operation for reading the patch toner image is performed.

In the conventional image forming apparatus for forming the toner images of four colors of yellow, magenta, cyan and black, as shown in FIG. 3(*a*), there is need to ensure unnecessary intervals for forming the patch toner images for the four colors. For this reason, a down time is undesirably increased.

In order to reduce the down time, a control time can be reduced by, e.g., decreasing a length of the patch toner images with respect to a conveying direction of the patch toner images. However, in the case where the patch toner image density is detected, the decrease in length of the patch toner images is liable to be affected by density variation or detection variation, so that there is a possibility of a lowering in density detection accuracy. This is because the density detection is repeated plural times within the patch toner images in consideration of the variations in density and detection within the patch toner images and a resultant average is used and therefore an error is increased with the decrease in number of the density detection.

In the image forming apparatus 100 in this embodiment, as shown in FIG. 3(*b*), the patch toner images of the plurality of colors are transferred and superposed on the intermediary transfer belt 51. Then, from a detection result of the superposed patch toner images on the intermediary transfer belt 51, the toner amount (image density or toner content) of each of the patch toner images is computed. The superposed multicolor patch toner images are formed and read, so that a measuring time for the patch toner images is decreased and thus it becomes possible to considerably reduce the down time.

However, as a density measuring sensor for the patch toner image, as described in the above-mentioned JP-A 2007-65641, the optical sensor for detecting the toner content by emitting infrared light and detecting reflected light or diffused light at an irradiation portion is generally used. When the optical sensor is used, it is difficult to detect the superposed patch toner images of the plurality of colors to obtain the toner amount of each of the patch toner images.

That is, the optical sensor does not directly detect color information of the toner. The information detectable by the optical sensor is a difference in amount of the reflected light (or the diffused light) between at a toner image portion and a non-toner image portion (the intermediary transfer belt surface) with respect to the emitted infrared light. In other words, the optical sensor detects a toner coating area on the intermediary transfer belt surface as the toner amount. For this reason, in the case where a secondary color patch toner image consisting of the superposed patch toner images of two colors is detected, the toner amount (toner coating area) as a total for the two colors can be obtained but the toner amounts for the respective colors cannot be separately detected.

For this reason, so long as the conventional optical sensor is used, in order to manage the respective color densities in the full-color image forming apparatus, as shown in FIG. 3(*a*), it is necessary to measure the patch toner image for each of the colors. Therefore, adverse effects such as the increase in down time and an increase in running cost have been undesirably caused to occur.

In this embodiment, in the image forming apparatus 100, by utilizing formation of half-tone toner images for the respective colors with different screen patterns so as to avoid moire, the detection result of the different patch toner images is separated into the densities of the respective color patch toner images. As a result, with a minimum down time, the density for each of the plurality of colors in the full-color image forming apparatus can be detected and controlled with accuracy.

Specifically, the image forming portions Pa,

Pb, Pc and Pd as the example of the toner image forming device form a first color toner image and a second color toner image on the intermediary transfer belt 51 as the example of the image conveying member so that at least one of a screen angle and a screen ruling (line number) are different.

A toner height sensor 30 as a detecting device detects a height of the patch toner image on the intermediary transfer belt 51 with rotation of the intermediary transfer belt 51 so as to measure a distribution of heights with respect to a movement of the toner image. This sensor is a laser displacement sensor for effecting triangular distance measurement at a surface irradiated with laser light. An object to be detected by the toner height sensor 30 is the multicolor patch toner image consisting of the patch toner images of the plurality of colors superposed in the same area. The toner height sensor 30 is disposed at a position in which the patch toner images of the plurality of colors pass through in a superposed state.

In the test image measuring mode, the patch toner images of the plurality of colors are formed and transferred on the intermediary transfer belt 51 at a sheet interval between adjacent print images. These patch toner images are half-tone toner images.

A control portion 50 as a controlling device computes the toner amount of an individual patch toner image by performing frequency analysis of the height distribution, with respect to a rotational direction (R.D.), of the "superposed patch toner images" detected by using the sensor 30. The control portion 50 performs one-dimensional Fourier transformation of the rotational direction height distribution of the superposed patch toner images to obtain a frequency distribution curve and outputs the toner amount, every peak on the frequency distribution curve, depending on an integrated value of the peak.

(Test Image Measuring Mode)

Figure 4:
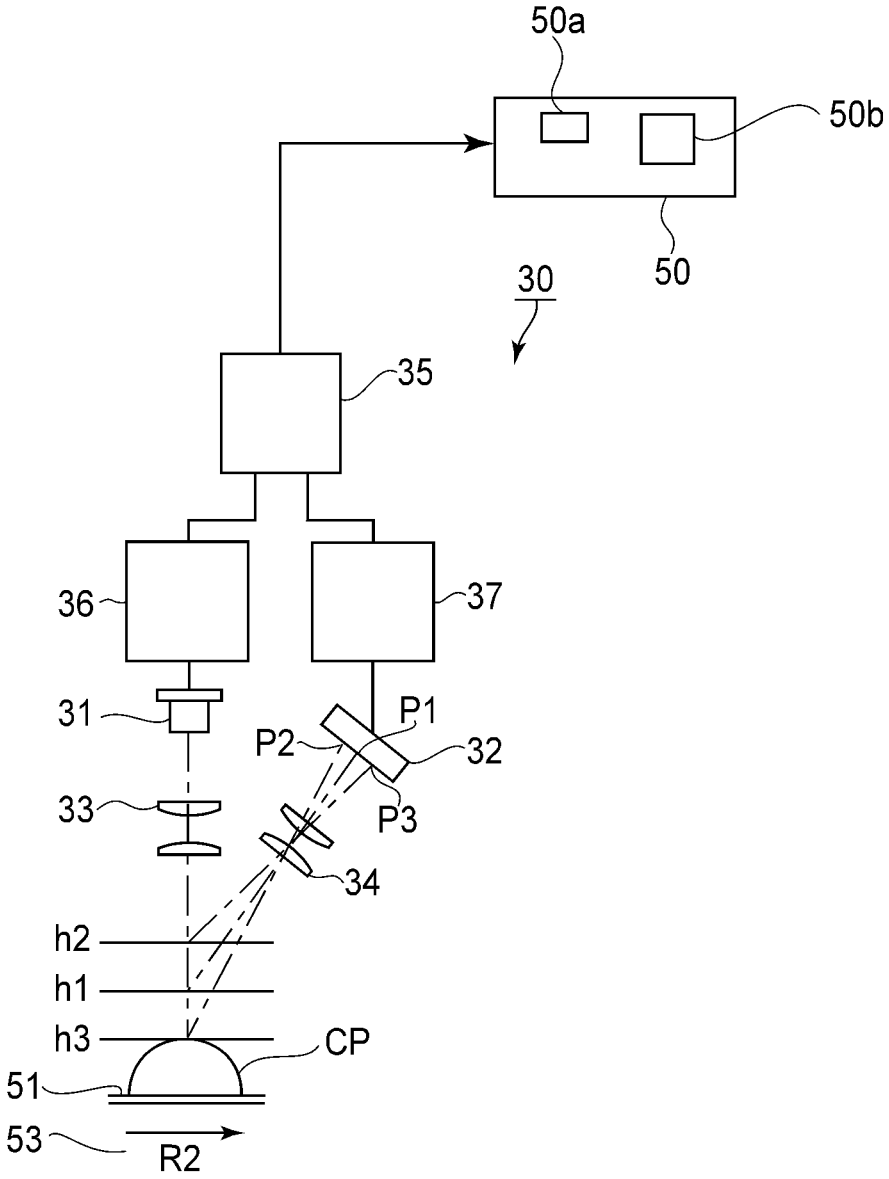
FIG. 4 is an explanatory view of a toner height sensor.
Figure 5:
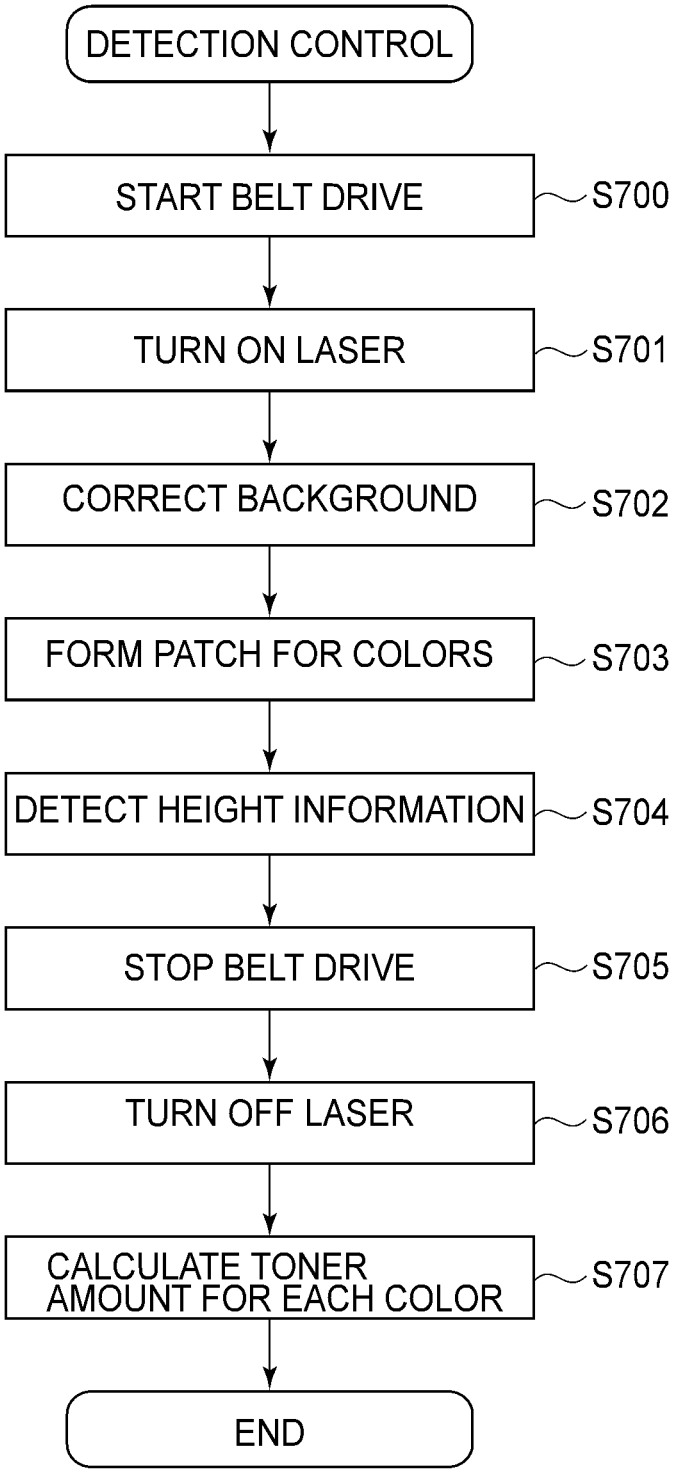
FIG. 5 is a flow chart of toner amount detecting control.
Figure 6:
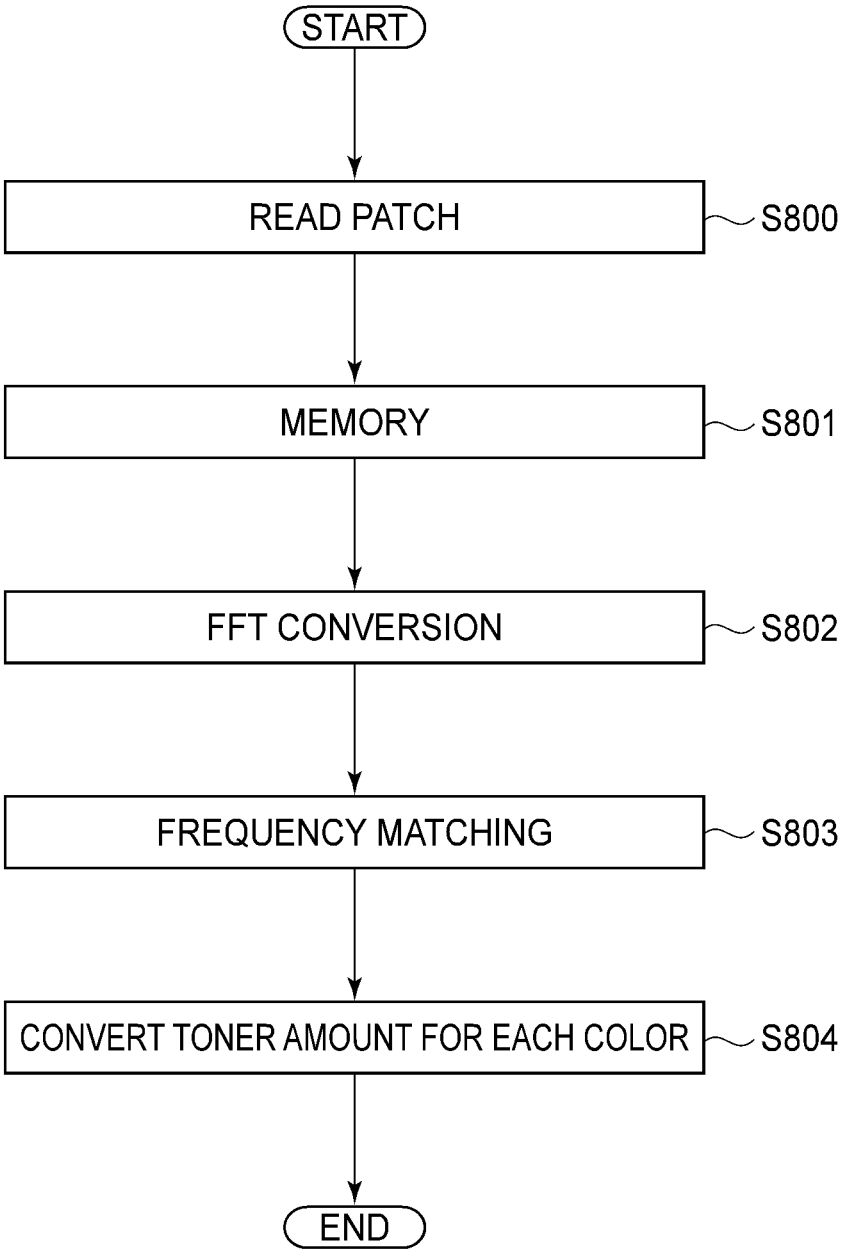
FIG. 6 is a flow chart of frequency analysis of a distribution of heights of the patch toner images with respect to a rotational direction.

FIG. 4 is an explanatory view of the toner height sensor. FIG. 5 is a flow chart of toner amount detection control. FIG. 6 is a flow chart of frequency analysis of the rotational direction height distribution of the patch toner images.

As shown in FIG. 1, the image forming portions, Pa, Pb, Pc and Pd form toner images for respective colors with latent image patterns subjected to half-toning using different screen patterns having different screen angles, respectively. The screen angle is represented by a clockwise angle difference with respect to the rotational direction when the rotational direction is taken as zero degrees. The yellow screen pattern has the screen angle of 90 degrees and the magenta screen pattern has the screen angle of 45 degrees. The cyan screen pattern has the screen angle of 57 degrees and the black screen pattern has the screen angle of 13 degrees. The latent image patterns for the colors have been subjected to half-toning at 200 lines/inch.

In order to detect and separate the superposed patch toner images into respective color components, there is need to provide different screen angles with respect to the same line number so that spatial frequencies of height distributions of the respective patch toner images do not overlap with each other. Further, e.g., in the case where the screen angles of 10 degrees and 170 degrees which provides line symmetry with respect to the conveying direction are set, resultant spatial frequencies overlap with each other, so that such a case is not preferable. Further, when the detected spatial frequency is excessively low, the spatial frequency causes trouble in frequency analysis, so that the screen angle for each of the plurality of colors may preferably be 10 degrees or more with respect to the conveying direction (rotational direction) of the intermediary transfer belt 51.

The toner image sensor 30 is disposed downstream of the image forming portion Pd with respect to the rotational direction of the intermediary transfer belt 51 and measures the height distribution of the superposed patch toner images of the plurality of colors.

In order to measure the patch toner image height distribution with predetermined accuracy, it is necessary to keep a distance between the toner height sensor 30 and the surface of the intermediary transfer belt 51 at a predetermined value. This is because a measurement error of the patch toner image height is caused when the distance between the toner height sensor 30 and the surface of the intermediary transfer belt 51 is fluctuated due to flapping of the intermediary transfer belt 51 during the drive.

Therefore, the toner height sensor 30 is disposed at a position in which the inner surface of the intermediary transfer belt 51 is supported by the driving roller 53. This is because at this position, the intermediary transfer belt 51 is provided with a certain tension by backup of the driving roller 53 and is rotated integrally with the driving roller 53 and thus a travelling (moving) surface of the intermediary transfer belt 51 on which the patch toner images are to be formed can be positioned at a predetermined height without being vibrated. As a result, the toner height sensor 30 can measure the patch toner image height information with accuracy while keeping a certain distance from the intermediary transfer belt 51.

As shown in FIG. 4, the toner height sensor 30 is the laser displacement sensor for effecting the triangular distance measurement in which a light beam is emitted from a semiconductor laser 31 as a light source and its reflected light is detected by a CCD 32 as a light-receiving element.

The semiconductor laser 31 outputs the laser beam (light) as the light beam for measurement by being driven by a driving circuit 36. The light beam output from the semiconductor laser 31 is shaped in a collimated light beam by a collimator lens 33 to reach a patch toner image CP as an object to be measured, thus forming an irradiation spot. The CCD 32 is disposed on an outgoing optical axis inclined from an incident optical axis of the semiconductor laser 31, so that the reflected light of the laser beam from the patch toner image CP forms an image on the CCD 32 through an imaging lens.

The CCD 32 is disposed on the outgoing optical axis inclined from the incident optical axis, so that in the case where a height of the surface of the patch toner image CP is hl, a light image with the irradiation spot is formed on the CCD 32 at a position P1. Further, in the case where the height of the surface of the patch toner image CP is h2, the light image with the irradiation spot is formed on the CCD 32 at a position P2.

In the case where the height of the surface of the patch toner image CP is h3, the light image with the irradiation spot is formed on the CCD 32 at a position P3.

Thus, the imaging position of the light image on the CCD 32 varies depending on the height of the surface of the patch toner image CP and from the CCD 32, a signal of a level corresponding to the imaging position of the light image is output. The patch toner image CP is rotated together with the intermediary transfer belt 51 at a constant speed of 300 mm/sec, so that a time-series signal depending on the height distribution of the patch toner image CP with respect to the rotational direction of the intermediary transfer belt 51 is output from the CCD 32.

The output from the CCD 32 is amplified in an amplifying circuit 37 and read by an arithmetic (computation) control circuit 35. The arithmetic control circuit 35 controls the driving circuit 36 to control the output of the semiconductor laser 31 and makes sampling of the output of the amplifying circuit 36 with a predetermined interval and then converts the sampled output into two-valued (binary) data, so that the data is successively output.

With respect to the semiconductor laser 31 of the toner height sensor 30, a laser spot diameter if 30 μm, a measurement resolution with respect to a height direction is 0.1 μm, and a resolution (sampling interval) with respect to the rotational direction is about 10 μm.

The control portion 50 calculates the toner amount (per unit area) of the patch toner image CP by computing the height information output from the arithmetic control circuit 35.

The control portion 50 forms the patch toner images of the plurality of colors when an instruction to execute the test image measuring mode is provided, and then transfers the patch toner images superposedly onto the intermediary transfer belt 51. The superposed patch toner images are detected by the toner height sensor 40, so that the toner amount of each of the color patch toner images is computed. In this embodiment, the toner amount detect control in the test image measuring mode performed in advance of start of image formation will be described.

As shown in FIG. 5 with reference to FIG. 1, when an instruction to effect the toner amount detection control is provided, the control portion 50 starts drive of the intermediary transfer belt 51 (S700) and turns on the semiconductor laser 31 (FIG. 4) of the toner height sensor 30 (S701).

The control portion 50 reads the height of the intermediary transfer belt 51, by using the toner height sensor 30 in a blank state in which no toner image is formed, in order to accurately read the toner image height by using the toner height sensor 30 (S702). The read data in the blank state is used as a correction data for a value of toner image height information described later.

The control portion 50 controls the toner image forming conditions of the toner image forming devices (Pa, Pb, Pc and Pd) on the basis of the height distribution of the first color test image and the second color test image detected by the detector 30. Specifically, the control portion 50 sets predetermined charging condition, exposure condition and developing condition for each of the image forming portions Pa, Pb, Pc and Pd and writes (forms) electrostatic images for predetermined patch toner images on the photosensitive drums 1*a*, 1*b*, 1*c* and 1*d*. Then, the predetermined oscillating voltage is applied to the developing sleeve 42 (FIG. 2) to form the respective color patch toner images and then the color patch toner images are primary-transferred onto the intermediary transfer belt 51 (S703).

Here, the respective color patch toner images have been subjected to different half-toning operations as described above and the writing timing of the electrostatic images is controlled so that the patch toner images are superposed on the intermediary transfer belt 51. The timing of the superposition is well known similarly as the normal image formation, thus being omitted from detailed description.

The superposed patch toner image (multiple-order color toner images) passes through the toner height sensor 30 at the speed of 300 mm/sec by the rotation of the intermediary transfer belt 51. The control portion 50 successively detect the toner height information by using the toner height sensor 30 during the passage of the superposed patch toner images through the toner height sensor 30 (S704). As a result, the height distribution of the superposed patch toner images with respect to the rotational direction is measured.

The control portion 50 stops, after the height distribution of the superposed patch toner images with respect to the rotational direction is measured, the drive of the intermediary transfer belt 51 (S705) and turns off the semiconductor laser (S706). The control portion 50 corrects the height distribution of the superposed patch toner images with respect to the rotational direction on the basis of the background information (S702) and then performs the frequency analysis to calculate the toner amount of the individual patch toner image for each of the plurality of colors (S707).

Incidentally, in the test image measuring mode executed at the image interval (corresponding to the so-called sheet interval), after the writing of the previous image is made in the step S700 in FIG. 5, the toner amount detection control is similarly effected and completed and then writing of a subsequent image is carried out.

As shown in FIG. 6 with reference to FIG. 4, the control portion 50 processes the height distribution data, with respect to the rotational direction, of the patch toner image CP detected by using the toner height sensor 30.

With the rotation of the intermediary transfer belt 51 in the direction of the arrow R2, the toner height sensor 30 reads the height distribution of the patch toner image CP with respect to the rotational direction (S800). That is, the patch toner image height distribution is successively detected by the toner height sensor 30 during the passage of the patch toner image CP, carried on the intermediary transfer belt 51, through the toner height sensor 30.

An arithmetic processing portion 50*b* prepares the height distribution data (FIG. 12) by correcting the patch toner image height distribution with the height of the background (intermediary transfer belt 51) as zero point, and stores the height distribution data in a memory 50*a* (S801).

Figure 12:
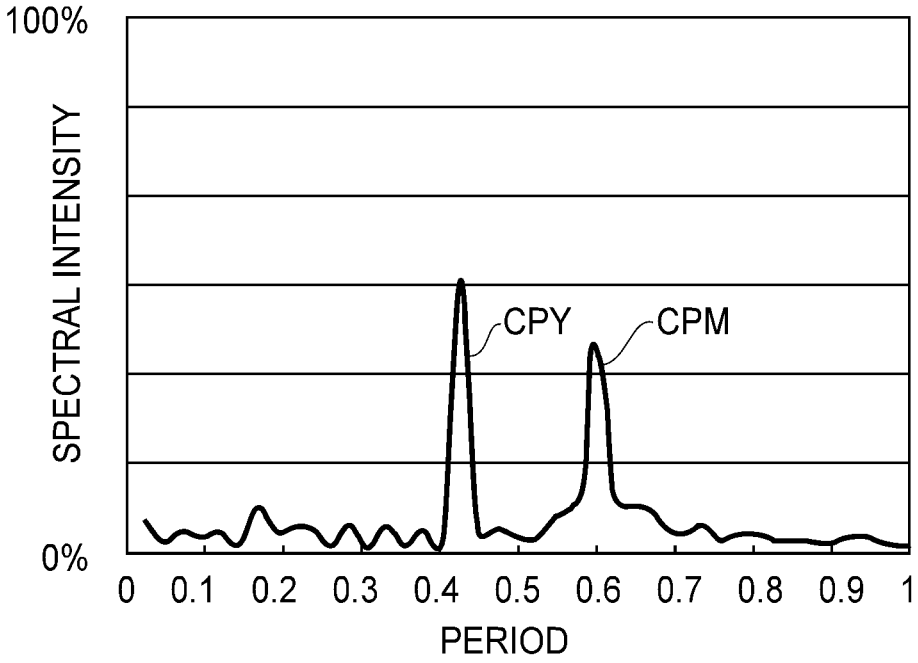
FIG. 12 shows a result of frequency analysis of the detection signal of the superposed patch toner images.
Figure 13:
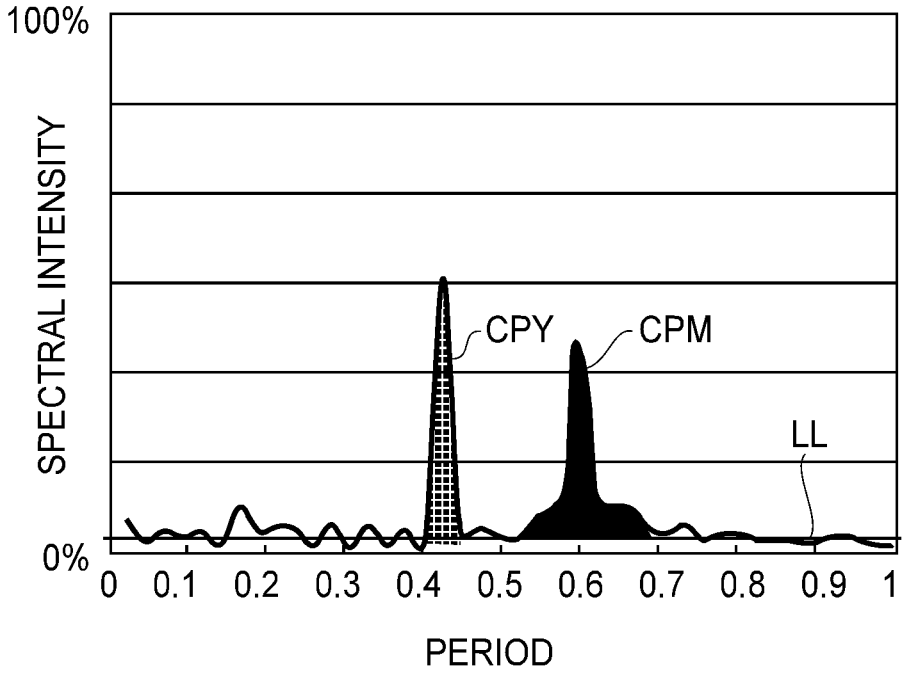
FIG. 13 is an explanatory view of integration processing.
Figure 14:
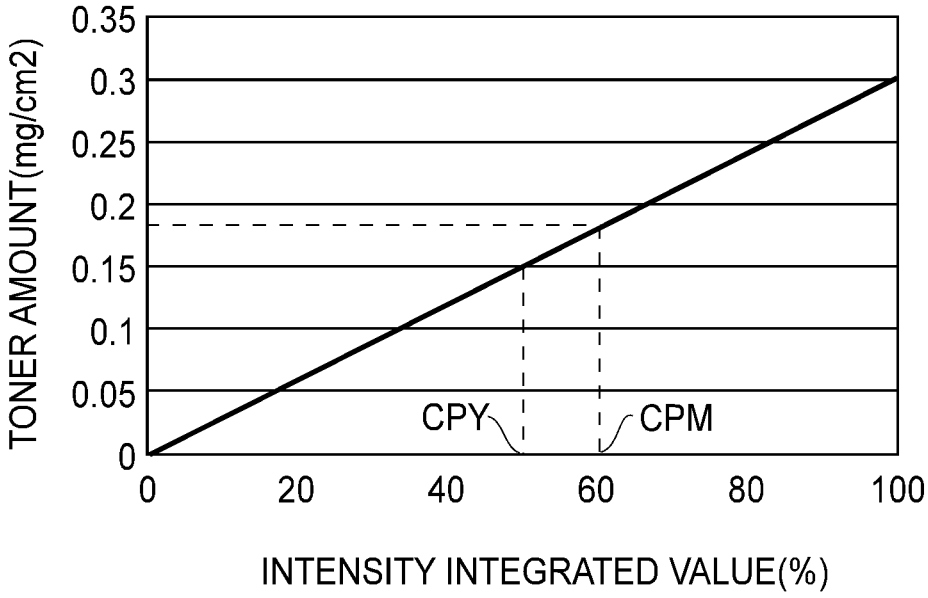
FIG. 14 is a graph showing a relationship between an integrated value and a toner amount per unit area.

After completion of the measurement, the arithmetic processing portion 40*b* calls up the height distribution data (FIG. 12) of the superposed patch toner images from the memory 50*a* and performs the one-dimensional Fourier transformation (S802). By the one-dimensional Fourier transformation, a result of the frequency analysis in which the peak is disposed every spatial frequency with respect to the rotational direction is obtained (FIG. 13). The height distribution data of the patch toner images subjected t6*o* the frequency analysis is divided into peaks which are superposed depending on the difference in spatial frequency with respect to the rotational direction, so that an area within each peak corresponds to the toner amount of an associated color (FIG. 14).

Here, the peak signal intensity corresponds to the toner amount, so that the toner amount is computable from the signal intensity. However, the patch toner image is formed, with a variation to some extent, from the electrostatic image through the development and transfer, so that the signal intensity after the Fourier transformation has a distribution every predetermined spatial frequency.

The arithmetic processing portion 50*b* computes an integrated value obtained by separating each peak area (S803) and converts the resultant value into the toner amount (S804). At this time, a weak intensity distribution portion which does not depend on the frequency of a predetermined level or less is the influence of fog toner or the like which does not depend on the screen pattern, and is present in a very small amount compared with the normal toner amount. Therefore, the weak intensity distribution portion (an area below the solid line in FIG. 14) is eliminated from the integrated area. As a result, the integrated area treated as the toner amount is a high intensity area in which the level of the peak signal intensity is not less than a predetermined (level required for the peak (S803).

The arithmetic processing portion 50*b* converts the integrated value for each individual peak into the toner amount of an associated color patch toner image (S804).

Thus, the screen angles for the respective colors are set so that periodicity of the toner amount with respect to the conveying direction is changed and then the height of the patch toner images is integrally measured by the toner height sensor 30. Thereafter, the measured height is separated into output values, at a specific frequency, calculated from the screen angle. For this reason, the detection of the toner amount, separately for the plurality of colors by using the superposed patch toner images, which has been difficult in the conventional optical sensor method becomes possible. As a result, an excess down time for forming the patch toner images for the four colors in the full-color image forming apparatus can e considerably reduced.

<Embodiment 1>

Figure 7:
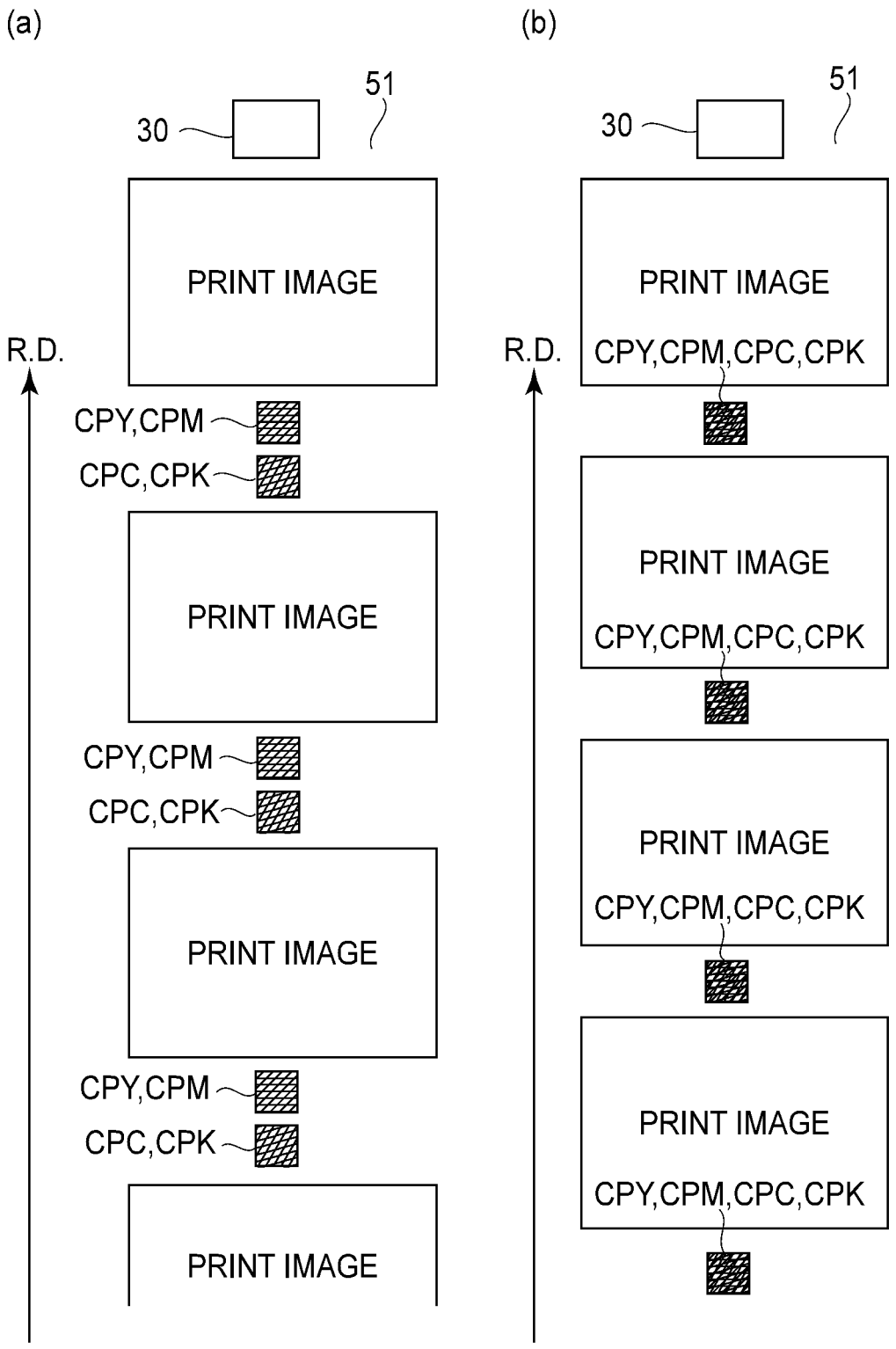
FIGS. 7(*a*) and 7(*b*) are explanatory views each showing an arrangement of patch toner images in Embodiment 1.
Figure 8:
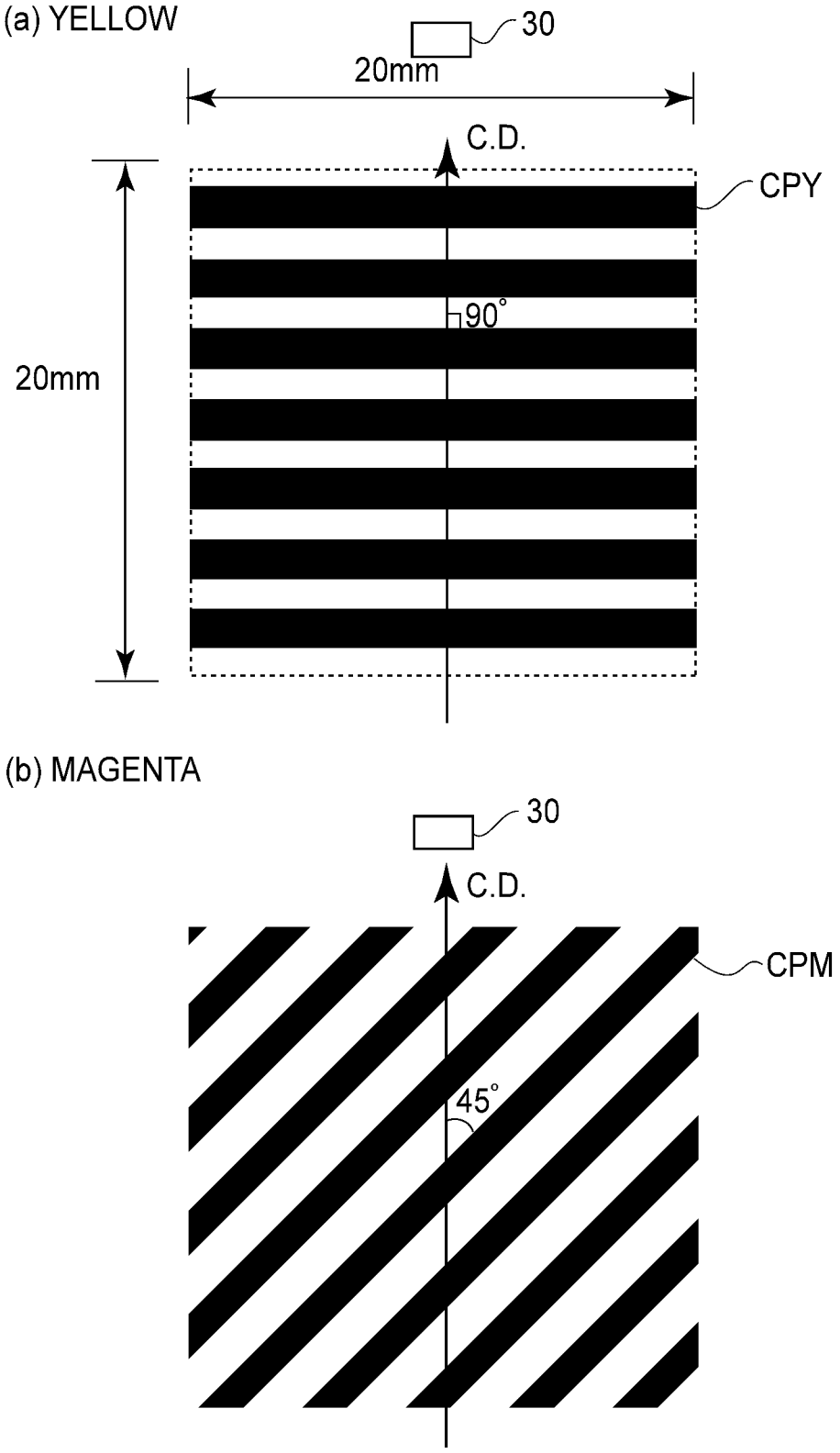
FIGS. 8(*a*) and 8(*b*) are explanatory views each showing an individual patch toner image.
Figure 9:
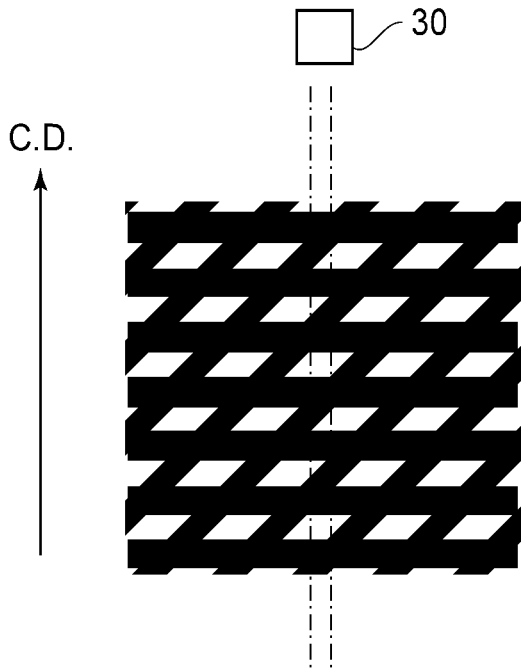
FIG. 9 is an explanatory view of superposed patch toner images.
Figure 11:
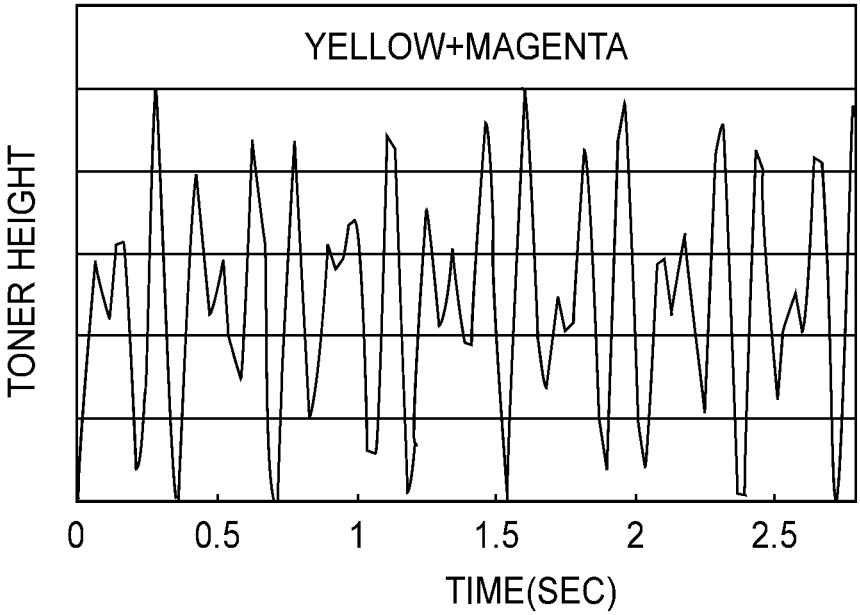
FIG. 11 shows a detection signal of the superposed patch toner images.
Figure 10:
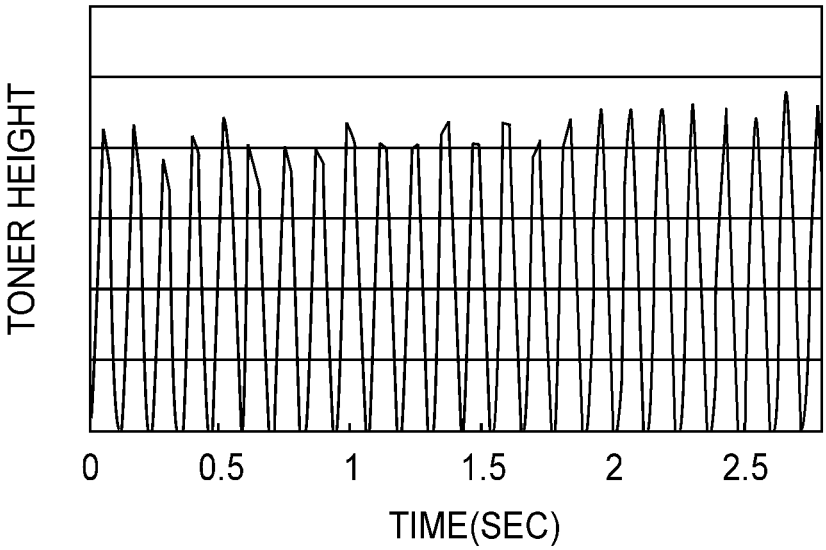
FIGS. 10(*a*) and 10(*b*) each shows a detection signal of the individual patch toner image.
Figure 10:
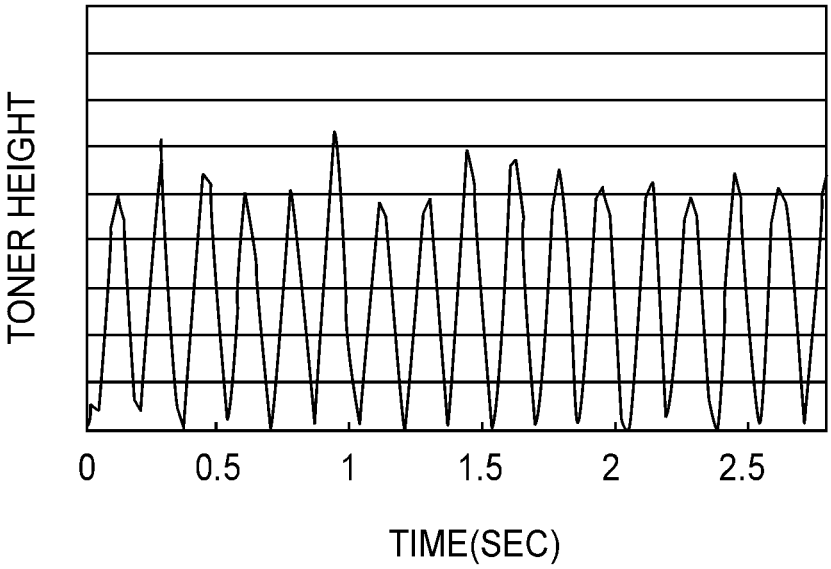

FIGS. 7(*a*) and 7(*b*) are explanatory views each showing an arrangement of patch toner images in Embodiment 1. FIGS. 8(*a*) and 8(*b*) are explanatory views each showing an individual patch toner image. FIG. 9 is an explanatory view of a superposed patch toner images. FIGS. 10(*a*) and 10(*b*) show a yellow patch toner image detection signal and a magenta patch toner image detection signal, respectively. FIG. 11 is a superposed patch toner image detection signal. FIG. 12 shows a result of frequency analysis of the superposed patch toner image detection signal. FIG. 13 is an explanatory view of integral processing. FIG. 14 is a graph showing a relationship between an integrated value and a toner amount.

As shown in FIGS. 7(*a*) and 7(*b*), in this embodiment, a yellow patch toner image CPY and a magenta patch toner image CPM are formed superposedly at an interval (spacing) between print images. Each of the yellow patch toner image CPY and the magenta patch toner image CPM is formed in a square shape of 20 mm×20 mm at a position in which the patch toner images pass through the toner height sensor 30 in the conveying direction (rotational direction).

As shown in FIG. 8(*a*), on the photosensitive drum 1*a* (FIG. 1), the yellow patch toner image CPY is formed with the screen angle of 90 degrees with respect to the conveying direction and the resolution of screen of 200 lines/inch (200 line images per one inch). For this reason, with respect to the conveying direction, a screen pitch (a distance between adjacent two lines) of the yellow patch toner image CPY is 0.127 mm (25.4 mm/200 lines).

As shown in FIG. 8(*b*), on the photosensitive drum 1*b* (FIG. 1), the magenta patch toner image CPM is formed with the screen angle of 45 degrees with respect to the conveying direction and the resolution of screen of 200 lines/inch. For this reason, with respect to the conveying direction, a screen pitch (a distance between adjacent two lines) of the magenta patch toner image CPM is 0.170 mm (25.4 mm/200 lines/sin 45°).

As shown in FIG. 9, on the intermediary transfer belt 51 (FIG. 1), the magenta patch toner image CPM is transferred and superposed on the yellow patch toner image CPY. In order to superpose the magenta patch toner image CPM on the yellow patch toner image CPY, exposure timing of each of the photosensitive drums 1*a* and 1*b* (FIG. 1) is controlled. The intermediary transfer belt 51 is driven at the process speed of 300 mm/sec, so that a distribution of patch toner image heights successively measured by using the toner height sensor 30 form an oscillatory pattern.

As shown in FIG. 10(*a*), in the case where only the yellow patch toner image CPY is transferred onto the intermediary transfer belt 51, the screen lines of the yellow patch toner image CPY is detected at a time interval of 0.420 msec (0.127 (mm)/300 (mm/sec)).

Further, as shown in FIG. 10(*b*), in the case where only the magenta patch toner image CPM is transferred onto the intermediary transfer belt 51, the screen lines of the magenta patch toner image CPM is detected at a time interval of 0.590 msec (0.170 (mm)/300 (mm/sec)).

As shown in FIG. 11, in the case where the yellow patch toner image CPY and the magenta patch toner image CPM are superposed, a spatial frequency pattern of height information is measured in the form of superposition of the two spatial frequency patterns shown in FIGS. 10(*a*) and 10(*b*). As shown in FIGS. 10(*a*) and 10(*b*), the periodicity in the case of the single color patch toner image can be clearly discriminated but in the case of the superposed color patch toner images as the multi-color color patch toner image, a clear period is less liable to be discriminated.

Therefore, the height information of the multi-order color patch toner image consisting of the superposed yellow and magenta patch toner images is subjected to the frequency analysis through the one-dimensional Fourier transformation with respect to the conveying direction (rotational direction) of the intermediary transfer belt 51. The computation of the one-dimensional Fourier transformation is well known in the art as a common method of calculation, thus being omitted from detailed description.

As shown in FIG. 12, when the height information signal in the form of the superposed yellow and magenta period patterns is subjected to the one-dimensional Fourier transformation, a yellow peak at a position of the period of 0.420 msec and a magenta peak at a position of the period of 0.590 msec are separately observed. The heights of the separate peaks at 0.420 msec and 0.590 msec correspond to toner heights on the intermediary transfer belt 51. Then, the toner image is formed with a variation to some extent with respect to the electrostatic image through the developing step and the transfer step, so that the height information signal subjected to the one-dimensional Fourier transformation has a distribution for each peak. For this reason, an area within the peak corresponds to the toner amount, so that the toner amount can be obtained by integral computation.

As shown in FIG. 13, in this embodiment, an integrated value of the area of each of the peak for CPM (magenta) and the peak for CPY (yellow) is obtained and then is converted into the toner amount. Here, an integrated area associated with the toner amount is the intensity area in which the signal (spectral) intensity is higher than a level indicated by a solid line LL in FIG. 13. The intensity area of the peak below the solid line LL in which frequency dependency is poor is created by the influence of the fog toner or the like which does not depend on the screen pattern, thus being eliminated from the integrated area. The intensity area of the peak below the solid line LL is present in a very small amount compared with the toner amount of the color patch and thus even in the case where the area is eliminated from the integrated area, a large error is not caused.

As shown in FIG. 14, the computed integrated value is converted into the toner amount. From the relationship shown in FIG. 14, the toner amount of the yellow patch toner image CPY was 0.15 mg/cm$^2$ and the toner amount of the magenta patch toner image CPM was 0.18 mg/cm$^2$.

Each of the thus-obtained toner amounts for yellow and magenta obtained from the superposed patch toner images was similar to the single color toner content (toner amount) individually measured by the conventional optical sensor. Therefore, the density control or the like in which the toner amount measured as described above is fed back can be carried out by the control as in the conventional manner.

For example, the toner amounts of the respective color patch toner images obtained in advance under a predetermined image forming condition (for charging, exposure and development) are set at reference toner amounts. Then, the reference toner amount and its associated toner amount obtained in the above-described manner are compared with each other. In the case where a difference between the two toner amounts is a predetermined amount or more, the image forming condition (for charging, exposure and development) is adjusted to set an optimum developing contrast, so that the toner amount converges at a constant value.

Incidentally, in this embodiment, the height information signal of the patch toner images different in spatial frequency is subjected to the frequency analysis through the one-dimensional Fourier transformation. For this reason, in the case where the screen angle is parallel to the conveying direction (rotational direction), i.e., zero degrees, when the patch toner images are conveyed, the screen lines and the toner height sensor 30 do not intersect with each other, so that the spatial frequency is not formed and thus the frequency analysis cannot be performed.

Therefore, in the case of using the patch toner image having the size of 20 mm with respect to the conveying direction and the screen ruling (line number) of 200 lines (per inch), the screen angle may preferably be at least 25 degrees with respect to the conveying direction. This is because the accuracy of the frequency analysis after the one-dimensional Fourier transformation depends on the number of the detected screen lines. As a result of a comparison experiment using different screen angles, when the detected number of the screen lines was 64 lines or more, it was confirmed that the difference between the calculated toner amount and an actual toner amount was a level of no problem in terms of product specification. On that basis, it is desirable that the screen angle is 25 degrees or more.

Further, in the case of the same screen ruling (lines/inch), a line-symmetric screen pattern including the screen lines with the screen angle of 30 degrees and the screen lines with the screen angle of 150 degrees with respect to the conveying direction of the intermediary transfer belt 51 cannot be separated by the frequency analysis. This is because the same period of the toner height distribution with respect to the conveying direction is obtained and therefore resultant peaks overlap with each other after the one-dimensional Fourier transformation.

For this reason, the screen angles for the respective colors in the case of same screen ruling are at least required to be different from each other, and the screen lines are required to be disposed asymmetrically with respect to the conveying direction and are required to form an angle of 10 degrees or more therebetween.

In Embodiment 1, the superposed patch toner images of the plurality of colors are read by the toner height sensor and can be detected by dividing the total toner height into toner heights for the plurality of colors, respectively, by the frequency analysis. For this reason, compared with the conventional density detection for each of the plurality of colors, the amounts of the toners of the plurality of colors can be collectively detected without lowering accuracy of toner amount management, so that the down time required for the control can be considerably reduced.

Incidentally, in Embodiment 1, the multi-color color patch consisting of the superposed patch toner images of the two colors of yellow and magenta is described as an example but it is also possible to measure the toner height distribution with respect to the conveying direction in a state in which three or four patch toner images (FIG. 7(*b*)) are superposed. For example, in Embodiment 1, as described above, the patch toner images of yellow, magenta, cyan and black are formed with the same screen ruling, different screen angles and asymmetrical screen lines with respect to the conveying direction. For this reason, the periods in the toner height distribution of the respective color patch toner images on the intermediary transfer belt 51 with respect to the conveying direction are different from each other. Therefore, by performing the frequency analysis through the one-dimensional Fourier transformation similarly as in Embodiment 1, it is possible to separately calculate each of the respective toner amounts from the four patch toner images.

Further, in Embodiment 1, one multi-order patch toner image with superposed one tone gradation of yellow and one tone gradation of magenta is formed every image interval but a plurality of multi-order patch toner images with superposed plural tone gradations of yellow and plural tone gradation of magenta may also be formed. It is also possible to effect control of the toner amount at each of respective tone gradations by forming the multi-order patch toner images with the plurality of tone gradations under different exposure conditions of the exposure device 3*a* and then subjecting the patch toner images to the frequency analysis through the one-dimensional Fourier transformation similarly as in Embodiment 1.

<Embodiment 2>

Figure 15:
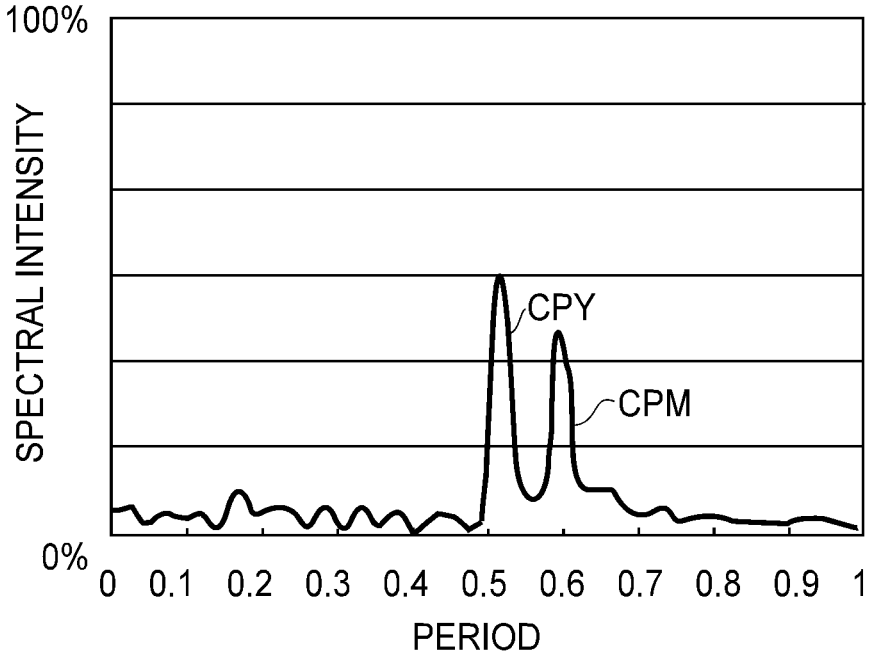
FIG. 15 shows a result of frequency analysis of the detection signal of the superposed patch toner images in Embodiment 2.

FIG. 15 shows a result of frequency analysis of detection signal of superposed patch toner images in Embodiment 2.

In Embodiment 1, the example in which the superposed patch toner images of yellow and magenta have the same screen ruling of 200 lines/inch but have the different screen angles was described. In Embodiment 2, the patch toner image of yellow having the screen ruling of 160 lines/inch and the patch toner image of magenta having the screen ruling of 200 lines/inch are superposed. The screen angle is 90 degrees for yellow and 45 degrees for magenta similar as in Embodiment 1. Constitutions and control except for the screen angle are similar to those in Embodiment 1, thus being omitted from redundant description.

The spatial frequency of the yellow patch toner image having the screen ruling of 160 lines/inch is 0.159 mm (25.4 mm/160 lines). The spatial frequency of the magenta patch toner image is 0.170 mm (25.4 mm/200 lines/sin)45° similarly as in Embodiment 1. Further, the conveying speed of the intermediary transfer belt 51 is 300 mm/sec.

As shown in FIG. 15, the height information signal of the superposed patch toner image with time (abscissa) is subjected to the frequency analysis. The yellow peak period is 0.530 msec (0.159 (mm)/200 (mm/sec)) and the magenta peak period is 0.590 msec similarly as in Embodiment 1. The multi-order patch toner image of the superposed patch toner images of yellow and magenta is subjected to the one-dimensional Fourier transformation. As a result, the peak at the period of 0.530 msec corresponds to the yellow toner height and the peak at the period of 0.590 msec corresponds to the magenta toner height.

In the control in Embodiment 2, the multi-color patch toner image obtained by superposing the patch toner images of the plurality of colors, in the same area, image-processed through the half-toning with changed screen angles or screen rulings is formed. Then, in-image plane height distribution information of the multi-order patch toner image is detected by the height detecting means. Then, from the periodicity of detected data, the toner amount of each of the patch toner images of yellow and magenta is calculated and the image density for each of the plurality of colors is adjusted depending on the information of the calculated toner amount.

In the control in Embodiment 2, each of the color toner height data is calculated by subjecting the information on the distribution of heights crossing the conveying direction of the multi-order patch toner image to the Fourier transformation. The Fourier transformation is the one-dimensional Fourier transformation, with respect to the conveying direction of the intermediary transfer belt (conveying member), in which the screen angles or screen rulings for the respective colors are set so that the toner height frequency characteristics with respect to the conveying direction are different from each other for each of the plurality of colors. The patch toner images are formed at half-toning gradation densities.

<Embodiment 3>

In Embodiment 3, control using the patch toner images in the image forming apparatus using a recording material conveying member will be described. The image forming apparatus using the recording material conveying member forms a full-color image by transferring and superposing the toner images of the plurality of colors from the image bearing member on the recording material carried on the recording material conveying member. The image forming apparatus using the recording material conveying member also includes those of the type using the single image bearing member for effecting development for the plurality of colors and the type in which color toner images are transferred and superposed from the plurality of image bearing members.

In the image forming apparatus in Embodiment 3, the plurality of color toner images different in screen pitch with respect to the rotational direction is formed and can be transferred onto the recording material carried on the recording material conveying member. When an instruction to execute the test image measuring mode is provided, the image forming portions directly transfer and superpose the patch toner images of the plurality of colors on the recording material conveying member. Then, by the height distribution detecting means, the height distribution of the patch toner images of the plurality of colors on the recording material conveying member is detected. The arithmetic computation means computes the toner amount of the individual patch toner image by performing the frequency analysis of the height distribution of the measured patch toner images of the plurality of colors with respect to the rotational direction.

<Embodiment 4>

In Embodiment 1, the toner amount for each color was obtained from the multi-order patch toner image and was compared with the reference density and then was fed back to the latent image condition, so that the image density was managed.

In Embodiment 4, the toner amount for each color is obtained from the multi-order patch toner image in the same manner as in Embodiment 1. Then, by using the obtained toner amount for each color, the resultant data is fed back to the toner supply control in the developing device of each color which has already been well known in the field of the single color density patch detection.

<Embodiment 5>

In Embodiment 1, the patch toner image of the respective colors were formed and superposed at the predetermined tone gradations and the thus-formed dedicated toner images were subjected to the height distribution measurement with respect to the rotational direction. However, the toner images for obtaining the toner amount of each color are not limited to the patch toner images. The toner amount of each color may also be obtained through the frequency analysis of the rotational direction height distribution measured by the toner height sensor 30 in the same manner as in Embodiment 1 with respect to the normal toner images to be transferred onto the recording material P.

<Embodiment 6>

In Embodiment 1, the respective color patch toner images different in screen pattern were formed and superposed. However, the pattern having the periodicity capable of permitting separation of the superposed patch toner images through the frequency analysis is not limited to the screen pattern. In Embodiment 6, the respective color patch toner images are formed in one dot width lines, with respect to the main scan direction, different in line pitch with respect to the rotational direction. With respect to the thus-formed "superposed patch toner images", the rotational direction height distribution is measured in the same manner as in Embodiment 1 and the result of the measurement is subjected to the frequency analysis, so that the toner amount of each color is obtained.

The image forming apparatus in Embodiment 6 includes the intermediary transfer member, the image forming portions capable of forming the toner images of the plurality of colors different in periodicity of the pattern with respect to the movement direction and then transferring the toner images superposedly, and the toner height sensor capable of detecting the rotational direction toner height of the toner images on the intermediary transfer member. The toner images of the plurality of colors transferred on the intermediary transfer member by the image forming portions are detected by the toner height sensor to measure the height distribution of the toner images of the plurality of colors with respect to the toner image movement direction. Thereafter, the measured height distribution of the toner images of the plurality of colors is subjected to the frequency analysis to compute the toner amount of the individual toner image.

By employing the constitutions of the above-described embodiments, the following effects can be achieved. That is, by utilizing the difference in periodicity of height distribution between the first color test image and the second color test image, it is possible to separate detected pieces of detection information on the superposed test images into individual detection information. For this reason, even when the first and second test images are collectively detected in the state in which the first and second test images are superposed, the toner image forming condition for each of the plurality of colors can be controlled.

Therefore, the test image measuring mode can be executed to control the toner image forming condition without increasing the interval between images (so-called sheet interval).

While the invention has been described with reference to the structures disclosed herein, it is not confined to the details set forth and this application is intended to cover such modifications or changes as may come within the purpose of the improvements or the scope of the following claims.

This application claims priority from Japanese Patent Application No. 086514/2009 filed Mar. 31, 2009, which is hereby incorporated by reference.

What is claimed is:

1. A color image forming apparatus comprising a first image forming device configured to form a first color toner image on an image conveying member using a first color toner;

a second image forming device configured to form a second color toner image, superposedly on the first color toner image, on the image conveying member using a second color toner having color which is different from color of the first color toner;

a third image forming device configured to form a third color toner image, superposedly on the first and second color toner images, on the image conveying member, using a third color toner having color which is different from the color of the first color toner and the color of the second color toner;

an executing device configured to execute a test mode in which first, second and third color test toner images are formed superposedly on the image conveying member by said first, second and third image forming devices so that at least one of a screen angle and a screen ruling with respect to the first, second and third color test toner image are different from each other;

a detecting device configured to detect a distribution of heights of the first and second and third color test toner images in a moving direction of the image conveying member, in the test mode; and a controlling device configured to control density of the first color toner image to be formed by said first image forming device and density of the second color toner image to be formed by said second image forming device and density of the third color toner image to be formed by said third image forming device, on the basis of the distribution of heights detected by said detecting device, respectively.

2. An apparatus according to claim 1, wherein said controlling device controls density of the first color toner image, density of the second color toner image and density of the third color image on the basis of a first color toner amount per unit area, a second color toner amount per unit area and a third color toner amount per unit area obtained by performing frequency analysis of the distribution of the heights of the first, second and third color test toner images.

3. An apparatus according to claim 2, wherein said controlling device controls density of the first color toner image, density of the second color toner image and density of the third color toner image on the basis of a first color toner amount per unit area, a second color toner amount per unit area and a second color toner amount per unit area corresponding to a peak-integrated value of each peaks on a frequency distribution curve obtained by subjecting the distribution of the first, second and third color test toner images to one-dimensional Fourier transformation.

4. An apparatus according to claim 1, wherein said detecting device includes a laser displacement sensor configured to subject a surface irradiated with laser light to triangular distance measurement.

5. An apparatus according to claim 1, further comprising an intermediate transfer member, as the image conveying member, configured to convey the first, second and third color toner images formed superposedly by said first, second and third image forming devices, and configured to transfer the first, second and third color toner images onto a recording material, wherein said detecting device detects the distribution of the heights of the first, second and third color test toner images on said intermediate transfer member.

6. An apparatus according to claim 5, wherein said first image forming device includes a photosensitive member on which is to be formed an electrostatic image, a developing device configured to develop the electrostatic image using the first color toner, and a transfer device configured to transfer the first color toner image onto said intermediate transfer member, and wherein said second image forming device includes a photosensitive member on which is to be formed an electrostatic image, a developing device configured to develop the electrostatic image using the second color toner, and a transfer device configured to transfer the second color toner image onto said intermediate transfer member, and wherein said third image forming device includes a photosensitive member on which is to be formed an electrostatic image, a developing device configured to develop the electrostatic image using the third color toner, and a transfer device configured to transfer the third color toner image onto said intermediate transfer member.

* * * * *